US006769887B2

(12) United States Patent
Ikeda et al.

(10) Patent No.: US 6,769,887 B2
(45) Date of Patent: Aug. 3, 2004

(54) SCROLL COMPRESSOR

(75) Inventors: Kiyoharu Ikeda, Tokyo (JP); Yoshihide Ogawa, Tokyo (JP); Takeshi Fushiki, Tokyo (JP); Teruhiko Nishiki, Tokyo (JP); Takashi Sebata, Tokyo (JP); Fumiaki Sano, Tokyo (JP); Shin Sekiya, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/240,281

(22) PCT Filed: Feb. 7, 2001

(86) PCT No.: PCT/JP01/00846

§ 371 (c)(1),
(2), (4) Date: Sep. 30, 2002

(87) PCT Pub. No.: WO02/063171

PCT Pub. Date: Aug. 15, 2002

(65) Prior Publication Data

US 2003/0077194 A1 Apr. 24, 2003

(51) Int. Cl.[7] ..... F04C 18/00

(52) U.S. Cl. ..... 418/55.5; 418/57; 418/55.4; 418/55.6

(58) Field of Search ..... 418/55.4, 55.5, 418/57, 55.6

(56) References Cited

U.S. PATENT DOCUMENTS 6,386,593 B1 * 5/2002 Slais et al. ..... 285/205

FOREIGN PATENT DOCUMENTS

| | | | | |
|---|---|---|---|---|
| JP | 3-172591 | | 7/1991 | |
| JP | 10-184568 | | 7/1998 | |
| JP | 11094490 A | * | 4/1999 | ..... F28F/21/06 |
| JP | 11-107938 | | 4/1999 | |
| JP | 2000-337273 | | 12/2000 | |
| JP | 2000-337276 | | 12/2000 | |
| JP | 2001304147 A | * | 10/2001 | ..... F04C/18/02 |

* cited by examiner

*Primary Examiner*—Thomas Demon
*Assistant Examiner*—Theresa Trieu
(74) *Attorney, Agent, or Firm*—Oblon, Spivak, McClelland, Maier & Neustadt, P.C.

(57) ABSTRACT

On the assumption that pressure Pm1 (MPa) of a boss portion outside space determined by a restrictor and a flow regulating valve provided midway in an oil feed passageway is expressed by Pm1=Ps+α, and a differential pressure value at which a difference between high and low pressures becomes minimum in a running pressure range of a scroll compressor is represented by min(Pd−Ps), the value a in the above expression is set to fall in a range expressed by 0<α<min(Pd−Ps). Here, Ps represents suction pressure (MPa) of the compressor, and Pd represents discharge pressure (MPa) of the compressor.

10 Claims, 10 Drawing Sheets

Correlation between value $\beta$ and Rated Performance Ratio

FIG. 10

Low Compression Ratio Running Pressure
in Respective Refrigerants
(CT/ET = 30/10℃)

| refrigerant | Pd(MPa) | Ps(MPa) | min(Pd-Ps)(MPa) |
|---|---|---|---|
| R22 | 1.19 | 0.68 | 0.51 |
| R407C | 1.27 | 0.71 | 0.56 |
| R410A | 1.88 | 1.08 | 0.80 |

SCROLL COMPRESSOR

TECHNICAL FIELD

The present invention relates to a refrigerant compressor for use in refrigerating/air-conditioning equipment.

BACKGROUND ART

FIG. 7 is a longitudinal sectional view showing the construction of a conventional scroll compressor disclosed in JP-A-2000-161254.

In FIG. 7, numeral 1 designates a fixed scroll having its outer circumferential portion fastened to a guide frame 15 by means of bolts (not shown). Plate-like scroll teeth 1*b* are formed on one surface (lower side in FIG. 7) of a base plate portion 1*a*. In addition, two Oldham's guide grooves 1*c* are formed substantially in a straight line in the outer circumferential portion. A claw 9*c* of an Oldham's ring 9 is reciprocally slidably engaged with each of the Oldham's guide grooves 1*c*. Further, from a side surface of the fixed scroll 1, a suction pipe 10*a* is press fitted through a closed vessel 10.

Numeral 2 designates an oscillating scroll, and plate-like scroll teeth 2*b* having substantially the same shape as the plate-like scroll teeth 1*b* of the fixed scroll 1 are provided on the upper surface of a base plate portion 2*a*. Thus, a compression chamber 1*d* is formed geometrically. A hollow cylindrical boss portion 2*f* is formed in the center portion of that surface of the base plate portion 2*a* which is opposite to the plate-like scroll teeth 2*b*. An oscillating bearing 2*c* is formed on the inner surface of the boss portion 2*f*. In addition, a thrust surface 2*d* which can slide in pressure contact with a thrust bearing 3*a* of a compliant frame 3, is formed on the same side surface as the boss portion 2*f* but on an outer side than the boss portion 2*f*. In the outer circumferential portion of the oscillating scroll base plate portion 2*a*, two Oldham's guide grooves 2*e* are formed substantially in a straight line to have a phase difference of 90 degrees with respect to the Oldham's guide grooves 1*c* of the fixed scroll 1. A claw 9*a* of the Oldham's ring 9 is reciprocally slidably engaged with each of the Oldham's guide grooves 2*e*. An extraction hole 2*j* is also provided in the base plate portion 2*a* so as to extend from the compression chamber 1*d* through the thrust surface 2*d*. An aperture portion 2*k* of the extraction hole 2*j* on the side of the thrust surface 2*d* is located so that the circular locus of the aperture portion 2*k* always stays inside the thrust bearing surface 3*a* of the compliant frame 3.

The compliant frame 3 has two upper and lower cylindrical surfaces 3*d* and 3*e* in its outer circumferential portion. The cylindrical surfaces 3*d* and 3*e* are supported in the radial direction of the scroll compressor by cylindrical surfaces 15*a* and 15*b* provided in the inner circumferential portion of the guide frame 15, respectively. A main bearing 3*c* and an auxiliary main bearing 3*h* for supporting a main shaft 4 in the radial direction of the scroll compressor are formed in the center portions of the compliant frame 3. The main shaft 4 is driven to rotate by a motor 7. In addition, between the outside of the compliant frame 3 and the inside of the guide frame 15, a frame space 15*f* is defined by sealing materials 16*a* and 16*b* disposed on cylindrical surfaces 15*c* and 15*d*, respectively. The frame space 15*f* communicates with the compression chamber 1*d* through a communication passageway 3*s* and the extraction hole 2*i* which are interconnected via the surface of the thrust bearing 3*a*. Thus, the frame space 15*f* is filled with refrigerant gas which is supplied from the compression chamber 1*d* and which is on the way of compression.

A regulating valve receiving space 3*p* is also formed in the compliant frame 3. One end (lower end in FIG. 7) of the regulating valve receiving space 3*p* communicates with a boss portion outside space 2*h*. The boss portion outside space 2*h* is constituted by the inner circumference of the compliant frame 3 and the thrust surface 2*d* of the oscillating scroll 2. On the other hand, the other end (upper end in FIG. 7) of the regulating valve receiving space 3*p* is made open to a suction pressure atmosphere space 1*g*. An intermediate pressure regulating valve 3*i* is reciprocally movably received in the lower portion of the regulating valve receiving space 3*p*. On the other hand, received in the upper portion of the regulating valve receiving space 3*p* is an intermediate pressure regulating spring retainer 3*t* fixedly attached to the compliant frame 3. Between the intermediate pressure regulating valve 3*i* and the intermediate pressure regulating spring retainer 3*t*, an intermediate pressure regulating spring 3*m* is received in such a manner that the spring 3*m* is made shorter than its natural length.

An outer circumferential surface 15*g* of the guide frame 15 is fixedly attached to the closed vessel 10 by shrink-fitting, welding, or the like. However, a channel is ensured by a notch portion 15*h* provided in the outer circumferential portion of the guide frame 15. Thus, high pressure refrigerant gas discharged from a discharge port 1*f* of the fixed scroll 1 is directed through the channel to a discharge pipe 10*b* provided on the motor side.

Numeral 4 designates a main shaft and an oscillating shaft 4*b* is formed in the upper end portion of the main shaft 4. The oscillating shaft 4*b* is rotatably engaged with the oscillating bearing 2*c* of the oscillating scroll 2. A main shaft balancer 4*e* is shrink-fitted in the lower portion of the oscillating shaft 4*b*. Further, under the main shaft balancer 4*e*, a main shaft portion 4*c* is formed so as to be rotatably engaged with the main bearing 3*c* and the auxiliary main bearing 3*h* of the compliant frame 3. In addition, an auxiliary shaft portion 4*d* is formed in the lower portion of the main shaft 4 so as to be rotatably engaged with an auxiliary bearing 6*a* of a sub-frame 6. A rotor 8 is shrink-fitted between the auxiliary shaft portion 4*d* and the main shaft portion 4*c*.

An upper balancer 8*a* is fixed to the upper end surface of the rotor 8 and a lower balancer 8*b* is fixed to the lower end surface of the rotor 8. Static balance and dynamic balance are ensured by the total of three balancers including the upper and lower balancers 8*a* and 8*b* in addition to the above-mentioned main shaft balancer 4*e*. Further, an oil pipe 4*f* is force fitted into the lower end of the main shaft 4. Thus, refrigerating machine oil 10*e* retained in the bottom portion of the closed vessel 10 is sucked up through the oil pipe 4*f*.

A glass terminal board 10*f* is provided at the side surface of the closed vessel 10. The motor 7 is connected with the glass terminal board 10*f* through lead wires.

Next, description will be made about the basic operation of the conventional scroll compressor.

A sucked refrigerant of low pressure enters the compression chamber 1*d* through the suction pipe 10*a*. The compression chamber id is defined by the plate-like scroll teeth of the fixed scroll 1 and the plate-like scroll teeth of the oscillating scroll 2. The oscillating scroll 2 driven by the motor 7 makes an eccentric turning motion while reducing the volume of the compression chamber 1*d*. On this compression stroke, the sucked refrigerant becomes high in pressure. Thus, the sucked refrigerant is discharged into the closed vessel 10 through the discharge port if of the fixed scroll 1.

On the other hand, the refrigerant gas of intermediate pressure on the way of compression on the above-mentioned compression stroke is directed from the extraction hole 2*j* of the oscillating scroll 2 to the frame space 15*f* through the communication passageway 3*s* of the compliant frame 3, so that the intermediate pressure atmosphere in this space is maintained.

The discharged gas of the high pressure fills the closed vessel 10 with the high pressure atmosphere. The discharged gas is eventually released from the discharge pipe 10*b* to the outside of the compressor.

The refrigerating machine oil 10*e* in the bottom portion of the closed vessel 10 is directed, by a differential pressure, to the oscillating bearing 2*c* through a hollow space 4*g* extending through the main shaft 4 in the axial direction and to the main bearing 3*c* through a side hole provided in the main shaft 4. The refrigerating machine oil 10*e* (which is generally formed into a two-phase flow of gas refrigerant and refrigerating machine oil because of the foaming of the refrigerant dissolved in the refrigerating machine oil) is made to have an intermediate pressure by the throttling action of the two bearings. The refrigerating machine oil 10*e* reaches the boss portion outside space 2*h* surrounded by the oscillating scroll 2 and the compliant frame 3. Then, the refrigerating machine oil 10*e* overcomes the force loaded by the intermediate pressure regulating spring 3*m* disposed in the regulating valve receiving space 3*p*. Thus, the refrigerating machine oil 10*e* pushes the intermediate pressure regulating valve 3*i*. Accordingly, the refrigerating machine oil 10*e* is introduced into the suction pressure atmosphere space 1*g* and sucked into the compression chamber 1*d* together with the low pressure refrigerant gas.

As described above, the intermediate pressure Pm1 (MPa) of the boss portion outside space 2*h* is substantially defined on the basis of the spring force of the intermediate pressure regulating spring 3*m* and the intermediate pressure exposure area of the intermediate pressure regulating valve 3*i*. Thus, the intermediate pressure Pm1 is controlled by a predetermined value α as follows:

$$Pm1=Ps+\alpha \quad (1)$$

wherein Ps represents the suction pressure or low pressure (MPa).

Here, the difference between the closed vessel pressure Pd (MPa) (i.e. the discharge pressure) and the boss portion outside space pressure Pm1 is an oil feed differential pressure ΔP required for feeding the refrigerating machine oil 10*e* to the main bearing 3*c* and the oscillating bearing 2*g*. It is necessary to always ensure a positive value for the oil feed differential pressure ΔP.

$$\Delta P=Pd-Pm1>0 \quad (2)$$

On the compression stroke, the refrigerating machine oil 10*e* is released from the discharge port 1*f* into the closed vessel 10 together with the high pressure refrigerant gas. Here, the refrigerating machine oil 10*e* is separated from the refrigerant gas, and returned to the bottom portion of the closed vessel again.

The compression chamber 1*d* for the refrigerant gas always or intermittently communicates with the frame space 15*f* through the extraction hole 2*j* provided in the base plate portion 2*a* of the oscillating scroll 2 and the communication passageway 3*s* provided in the compliant frame 3. Since the frame space 15*f* is a space closed by the two sealing materials 16*a* and 16*b*, the pressure in the frame space 15*f* breathes and changes in response to the change in pressure of the compression chamber 1*d*. The pressure in the frame space 15*f* is roughly equal to the integrated average value of the pressure changes in the compression chamber 1*d* with which the extraction hole 2*j* communicates.

As described above, the intermediate pressure Pm2 (MPa) of the frame space 15*f* is controlled by a predetermined magnification value β determined by the position of the compression chamber 1*d* with which the extraction hole 2*j* communicates, as follows.

$$Pm2=Ps\times\beta \quad (3)$$

wherein Ps represents the suction pressure or low pressure (MPa).

Here, Fpm1 represents the force tending to cause the compliant frame 3 and the oscillating scroll 2 to separate from each other due to the intermediate pressure Pm1 in the boss portion outside space 2*h*. In addition, Fgth represents the thrust gas force tending to cause the fixed scroll 1 and the oscillating scroll 2 to separate from each other in the axis direction due to the compression operation. Thus, the sum of the two forces Fpm1 and Fgth acts on the compliant frame 3 as a force for moving the compliant frame 3 in the opposite direction to the compression chamber 1*d*.

On the other hand, Fpm2 represents the force tending to cause the compliant frame 3 and the guide frame 15 to separate from each other due to the intermediate pressure Pm2 of the frame space 15*f* to which the refrigerant gas on the way of compression has been directed. In addition, Fpd2 represents the differential pressure which acts on the lower portion exposed to the high pressure atmosphere. Thus, the sum of the two forces Fpm2 and Fpd2 acts on the compliant frame 3 as a force to move the compliant frame 3 toward the compression chamber.

During the steady-state operation, the force to move the compliant frame 3 toward the compression chamber is set to exceed the force to move the compliant frame 3 in the opposite direction to the compression chamber. Thus, the compliant frame 3 is guided by the engaging upper and lower cylindrical surfaces 3*d* and 3*e* so as to move toward the compression chamber. The oscillating scroll 2 moves in the same direction as the compliant frame 3 while sliding on the compliant frame 3 in close contact therewith and also causing its plate-like scroll teeth 2*b* to slide in contact with the fixed scroll 1.

On the other hand, the above-mentioned thrust gas force Fgth increases during the starting, fluid compression, or the like. Thus, the oscillating scroll 2 strongly presses down the compliant frame 3 through the thrust bearing 3*a*. As a result, there is produced a comparatively large clearance between the tooth tips and the tooth bottoms of the oscillating scroll 2 and the fixed scroll 1. Thus, the pressure in the compression chamber is prevented from abnormally increasing. This action is called "relief action", and the amount of the produced clearance is called "relief amount".

The relief amount is controlled by a distance of travel by which the compliant frame 3 and the guide frame 15 collide with each other.

A part or the whole of upsetting moment generated in the oscillating scroll 2 is transmitted to the compliant frame 3 through the thrust bearing 3*a*. However, a bearing load applied by the main bearing 3*c*, and a resultant of two reactions thereof, that is, a couple produced by a resultant of counterforces applied by the two upper and lower cylindrical engaging surfaces 3*d* and 3*e* of the compliant frame 3 and the guide frame 15 act on the compliant frame 3 so as to cancel the above-mentioned upsetting moment. Thus, excellent steady-state operation follow-up action and relief action stability are ensured.

Next, detailed description will be made about the relationship of axial forces acting on the conventional scroll compressor.

FIG. 8 illustrates the relationship of axial forces acting on the oscillating scroll 2 and the compliant frame 3 in the conventional scroll compressor.

Fgth represents the counterforce generated by compressing the refrigerant gas, and Ftip represents the tooth tip contact force generated by making the fixed scroll 1 and the oscillating scroll 2 slide in contact with each other at the tooth tips. Thus, the counterforce Fgth and the tooth tip contact force Ftip act on the oscillating scroll 2 in the downward direction in FIG. 8. On the other hand, Fpm1 represents the force tending to cause the oscillating scroll 2 and the compliant frame 3 to separate from each other by the pressure Pm1 in the boss portion outside space 2*h*. In addition, Fpd1 represents the force acting on the inside of the boss portion of the oscillating scroll exposed to the high pressure atmosphere due to the differential pressure. Further, Fth represents the thrust contact force generated by the thrust surface sliding in contact with the compliant frame 3. Thus, the forces Fpm1, Fpd1 and Fth act on the oscillating scroll 2 as upward forces in FIG. 8. Here:

$$Fpm1=Spm1\times(Pm1-Ps) \quad (4)$$

$$Fpd1=Spd1\times(Pd-Ps) \quad (5)$$

wherein:

Spm1 represents an acting area ($m^2$) of the intermediate pressure Pm1 in the boss portion outside space Spd1 represents an acting area ($m^2$) of the discharge pressure Pd in the boss portion inside space Pd represents the discharge pressure (MPa)

Ps represents the suction pressure (MPa).

Accordingly, the force acting on the oscillating scroll 2 is expressed by:

$$Fgth+Ftip=Fth+Fpm1+Fpd1 \quad (6)$$

On the other hand, the force Fpm2 and the thrust contact force Fth act on the compliant frame 3 as downward forces in FIG. 8. The force Fpm2 is a force tending to cause the oscillating scroll 2 and the compliant frame 3 to separate from each other due to the intermediate pressure Pm1 of the boss portion outside space 15*h*. The thrust contact force Fth is generated when the compliant frame 3 slides in contact with the oscillating scroll 2. On the other hand, force Fpm2 and force Fpd2 act on the compliant frame 3 in the upward direction in FIG. 8. The force Fpm2 is a force tending to cause the compliant frame 3 and the guide frame 15 to separate from each other due to the intermediate pressure Pm2 of the frame space 15*f*. The force Fpd2 is generated by the differential pressure acting on the lower end portion of the compliant frame exposed to the high pressure atmosphere.

$$Fpm2=Spm2\times(Pm2-Ps) \quad (7)$$

$$Fpd2=Spd2\times(Pd-Ps) \quad (8)$$

wherein:

Spm2 represents an active area ($m^2$) of the intermediate pressure Pm2 in the frame space Spd2 represents the area ($m^2$) in which the compliant frame is exposed to the discharge pressure atmosphere at its lower end Pd represents the discharge pressure (MPa)

Ps represents the suction pressure (MPa).

Accordingly, the force acting on the compliant frame 3 is expressed by:

$$Fpm1+Fth=Fpm2+Fpd2 \quad (9)$$

By the simultaneous equations (6) and (9), the tooth tip contact force Ftip and the thrust contact force Fth can be obtained.

$$Ftip=Fpd1+Fpd2+Fpm2-Fgth \quad (10)$$

$$Fth=Fpm2+Fpd2-Fpm1 \quad (11)$$

The expression (10) shows that the tooth tip contact force Ftip increases as the force Fpm2 (the force tending to cause the compliant frame 3 and the guide frame 15 to separate from each other due to the pressure Pm2 of the frame space 15*f*) is set to be larger. In other words, the tooth tip contact force Ftip increases as the intermediate pressure Pm2 of the frame space 15*f* is set to be higher (the value $\beta$ is set to be larger).

On the other hand, the expression (11) shows that the thrust contact force Fth decreases as the force Fpm1 (the force tending to cause the compliant frame 3 and the oscillating scroll 2 to separate from each other due to the pressure Pm1 of the boss portion outside space 2*h*) is set to be larger. In other words, the thrust contact force Fth decreases as the intermediate pressure Pm1 of the boss portion outside space 2*h* is set to be higher (the value $\alpha$ is set to be larger). That is, it is so constructed that the thrust sliding loss can be reduced so as to be useful in saving the electrical power supplied to the compressor.

As described above, the tooth tip contact force Ftip or the thrust contact force Fth can be adjusted desirably by adjusting the pressure Pm1 in the boss portion outside space or the pressure Pm2 in the frame space. However, positive values must be always ensured for the two forces in order that the compressor performs out a normal compressing operation.

$$Ftip>0 \quad (12)$$

$$Fth>0 \quad (13)$$

Referring now to FIG. 9, the sealing materials will be described hereinafter. The sealing materials are provided on the cylindrical engaging surfaces of the guide frame 15 and the compliant frame 3 so as to form the frame space 15*f*.

Since the refrigerant gas on the way of compression is extracted and introduced into the frame space 15*f*, the pressure levels during the normal operation are generally expressed by:

$$Ps<Pm2<Pd \quad (14)$$

Accordingly, the sealing materials usually constituted by a U-ring for preventing discharge pressure gas from entering the frame space 15*f* and another U-ring for preventing gas from leaking from the frame space 15*f* to the suction pressure atmosphere are provided in the direction shown in FIG. 9. Teflon or the like is often used as the material of the U-rings.

In the conventional scroll compressor, as described previously, when the intermediate pressure Pm1 of the boss portion outside space 2*h* is set to be high, the thrust contact force Fth shown by the expression (11), that is, the thrust sliding loss can be reduced so that the electrical power supplied to the compressor can be saved. However, if the pressure Pm1 is set to be too high, the thrust contact force Fth takes a negative value (Fth<0). Accordingly, the oscillating scroll 2 and the compliant frame 3 are separated from each other so that a normal compressing operation cannot be carried out. In addition, the oscillating scroll 2 fluctuates in the clearance of the axial relief amount so that the oscillating bearing functions as one-sided bearing. Thus, there is a problem that abnormal wear, damage, or the like, is caused.

Likewise, if the pressure Pm1 is set to be too large, the expression (2) ΔP=Pd−Pm1 takes a negative value (ΔP=Pd−Pm1<0). Accordingly, the differential pressure for feeding oil to the oscillating bearing 2*c* and the main bearing 3*c* cannot be ensured, so that there is a problem that the bearings are damaged or the like.

The present invention has been made to solve such problems. It is an object of the present invention to provide a scroll compressor of the type described which has high performance and high reliability in that an upper limit is set to the value a in the expression (1) so as to preset the pressure Pm1 of the boss portion outside space 2*h* and keep the thrust contact force Fth proper so that the thrust sliding loss is reduced while performing a normal compressing operation without occurrence of separation between the oscillating scroll 2 and the compliant frame 3, that abnormal wear or damage is not produced in the oscillating bearing, and that the oil feed differential pressure is ensured to prevent the oscillating shaft and the main shaft from being damaged.

In the conventional scroll compressor, if the intermediate pressure Pm2 of the frame space 15*f* is set to be too low, no force is generated to move the compliant frame 3 toward the compression chamber. As a result, the value of the tooth tip contact force Ftip becomes negative. Thus, during the steady-state operation, the fixed scroll 1 and the oscillating scroll 2 are separated from each other so that a normal compressing operation cannot be effected. In addition, there is such a problem that the oscillating scroll 2 fluctuates in the clearance of the axial relief amount so that the bearings are damaged. On the contrary, if the intermediate pressure Pm2 is set to be too high, the tooth tip contact force Ftip becomes so large that the sliding loss increases. Thus, the electrical power supplied to the compressor increases. In addition, there is such a problem that the tooth tips are worn abnormally, and as the worst case, the tooth tips seize.

The present invention has been made in order to solve such problems, and it is another object of the present invention to provide a scroll compressor of the type described which has high performance and high reliability in that the value β in the expression (3) is set in a proper range with the result that the compliant frame 3 is moved toward the compression chamber positively so that the fixed scroll and the oscillating scroll are brought into close contact with each other by a proper pressing force in the axial direction of the compressor and thus the tooth tip contact force Ftip is maintained so proper that a normal compressing operation is ensured, that the bearings, for example, are prevented from being damaged, that the sliding loss is prevented from increasing, and that the tooth tips are prevented from being abnormally worn or from seizing.

Further, in the conventional scroll compressor, two sealing materials are used to form the frame space 15*f*. Accordingly, the sealing materials themselves cost, and it is necessary to form two grooves for disposing the sealing materials. Thus, there is a problem that much working time and cost are required.

The present invention has been made in order to solve such problems, and it is another object of the present invention to provide a scroll compressor of the type described which is superior in productivity in that the number of sealing materials themselves and the number of steps for forming the grooves for disposing the sealing materials can be reduced, and that the working for the extraction hole 2*j*, the communication passageway 3*s*, and so on, can be eliminated thereby reducing the parts cost and the working cost.

In addition, the conventional scroll compressor uses U-rings made of Teflon or the like as the sealing materials. Accordingly, the material itself is comparatively expensive.

In addition, in the case where the closed vessel is in balanced pressure, as before the compressor starts up, the pressure increases as follows. In the frame space 15*f* where the refrigerant gas of the intermediate pressure is extracted on the way of compression carried out in the compression chamber 1*d* immediately after the compressor starts up, the pressure increases comparatively rapidly, while, in the closed vessel, the volume is much larger than the volume of the frame space 15*f* so that the pressure increases more slowly than the frame space 15*f*.

In such a case, for a certain period of time, the pressure levels of the pressure Pm2 of the frame space 15*f* and the closed vessel pressure (that is, discharge pressure) Pd come into the condition shown by the following expression.

$$Pm2>Pd \tag{15}$$

On the assumption of steady-state operation, the sealing materials are formed so as to prevent discharge pressure gas from entering the frame space 15*f*. However, the sealing materials cannot prevent the flow reverse to that of the discharge pressure gas. In the condition shown by the expression (15), the refrigerant gas in the frame space 15*f* leaks out into the closed space so that the pressure Pm2 in the frame space does not increase. Thus, the force required to move the compliant frame 3 toward the compression chamber becomes insufficient. In other words, it takes a long time to start a normal compressing operation. In addition, during this period, the compliant frame 3 and the oscillating scroll 2 moving in the axial direction of the compressor in contact with the compliant frame 3 fluctuate in the clearance of the axial relief amount. Thus, there is a problem that damage, seizing, or the like, is caused to the bearings by the occurrence of one-sided bearing of the bearings.

The present invention has been made in order to solve such problems. According to the present invention, O-rings are used instead of Teflon so that the material cost can be reduced.

Even during the starting of the compressor, the pressure Pm2 of the frame space 15*f* is quickly increased without leaking the refrigerant gas of intermediate pressure supplied from the compression chamber 1*d* to the frame space 15*f*. Thus, the force required to move both the compliant frame 3 and the oscillating scroll 2 toward the compression chamber is generated positively so that a normal compressing operation can be started quickly.

It is therefore another object of the present invention to provide a scroll compressor of the type described which is low in cost, superior in starting performance, free from damage of bearings, and high in reliability.

In addition, if conventional O-rings typically made of CR (chloroprene rubber) are used as the sealing materials in the case where an HFC refrigerant (R407C, R410A, etc.) is used as a working fluid, the O-rings are swollen and deteriorated due to compatibility with the refrigerant. Thus, there is a problem that the sealing materials lose their sealing properties.

The present invention has been made in order to solve such a problem. It is therefore another object of present invention to provide a highly reliable scroll compressor of the type described in which O-rings made of HNBR (in which hydrogen atoms are bonded with a part of acrylonitrile-butadiene rubber molecules) are used for the HFC refrigerant so that the O-rings do not deteriorate and do not lose their sealing properties.

DISCLOSURE OF INVENTION

According to the present invention, there is provided a scroll compressor disposed in a closed vessel, comprising: a fixed scroll and an oscillating scroll respectively having plate-like scroll teeth in gear with each other so as to form a compression chamber therebetween; a compliant frame for supporting the oscillating scroll in an axial direction of the scroll compressor while supporting a main shaft in a radial direction of the scroll compressor for driving the oscillating scroll, the compliant frame being displaceable in the axial direction; and a guide frame for supporting the compliant frame in the radial direction, the oscillating scroll being made movable in the axial direction due to movement of the compliant frame in the axial direction relative to the guide frame; wherein the oscillating scroll has a thrust surface on a surface opposite to the plate-like scroll teeth; wherein a boss portion outside space formed inside a thrust bearing of the compliant frame slidable in pressure contact with the thrust surface is disposed midway in a differential pressure oil feed passageway for feeding lubricating oil by use of a running high/low pressure difference of the compressor; and wherein on the assumption that pressure Pm1 (MPa) of the boss portion outside space determined by a restrictor and a pressure regulator provided midway in the oil feed passageway is expressed by Pm1=Ps+$\alpha$ and a differential pressure value at which a difference between the high and low pressures becomes minimum in a running pressure range of the scroll compressor is expressed by min(Pd−Ps), the value a in the above expression is set to fall in a range of:

$$0<\alpha<\min(Pd-Ps)$$

where

Ps is suction pressure (MPa) of the compressor

Pd is discharge pressure (MPa) of the compressor.

Thus, the highly reliable scroll compressor is obtained which ensures a differential pressure for feeding oil to the oscillating bearing and the main bearing in the whole running pressure range of the compressor while preventing the compliant frame and the oscillating scroll from separating from each other.

Further, in a scroll compressor which is provided in a closed vessel and which comprises: a fixed scroll and an oscillating scroll respectively having plate-like scroll teeth in gear with each other so as to form a compression chamber therebetween; a compliant frame for supporting the oscillating scroll in an axial direction of the scroll compressor while supporting a main shaft in a radial direction of the scroll compressor for driving the oscillating scroll, the compliant frame being displaceable in the axial direction; and a guide frame for supporting the compliant frame in the radial direction, the oscillating scroll being made movable in the axial direction due to movement of the compliant frame in the axial direction relative to the guide frame, refrigerant gas on the way of compression is extracted from the compression chamber and introduced into a closed frame space formed by disposing two sealing materials on cylindrical surfaces or flat surfaces formed by the compliant frame and the guide frame, and pressure Pm2 (MPa) in the frame space is set to fall in a range of not less than 1.2 times and not more than 2 times the suction pressure Ps (MPa) of the compressor.

Thus, the highly reliable high-efficiency scroll compressor is obtained which makes the fixed scroll and the oscillating scroll slide in contact with each other by a proper pressing force in the whole running pressure range of the compressor so that the fixed scroll and the oscillating scroll are prevented from separating from each other and any increase in sliding loss or seizing caused by excessive pressing is prevented.

Further, in a scroll compressor which is provided in a closed vessel and which comprises: a fixed scroll and an oscillating scroll respectively having plate-like scroll teeth in gear with each other so as to form a compression chamber therebetween; a compliant frame for supporting the oscillating scroll in an axial direction of the scroll compressor while supporting a main shaft in a radial direction of the scroll compressor for driving the oscillating scroll, the compliant frame being displaceable in the axial direction; and a guide frame for supporting the compliant frame in the radial direction, the oscillating scroll being made movable in the axial direction due to movement of the compliant frame in the axial direction relative to the guide frame, a sealing material for stopping fluid from moving from a high pressure space to a low pressure space is disposed on a cylindrical surface or a flat surface formed by the compliant frame and the guide frame.

Thus, the scroll compressor is obtained in which the number of parts, the working time and the cost are reduced and which is low in cost and high in productivity.

In addition, if each sealing material is formed into an O-ring, the cost of the sealing material can be reduced. Further, even during starting of the compressor, the compliant frame and the oscillating scroll move toward the compression chamber quickly without leaking the pressure of the frame space into the closed vessel. Thus, a normal compressing operation can be started. Accordingly, the scroll compressor is obtained which is low in cost and high in reliability.

In addition, in the case of an HFC refrigerant (R407C, R410A, etc.) used as a working fluid, the sealing material may be made of HNBR (in which hydrogen atoms are bonded with a part of acrylonitrile-butadiene rubber molecules) and formed into an O-ring. As a result, it is possible to obtain sealing properties which ensure the reduced danger of swelling or deteriorating of the O-ring. Thus, the highly reliable scroll compressor is obtained.

BRIEF DESCRIPTION OF DRAWINGS

FIG. 10 is a table of low compression ratio running pressures in respective refrigerants according to the present invention.

BEST MODE FOR CARRYING OUT THE INVENTION

Embodiment 1

Figure 1:
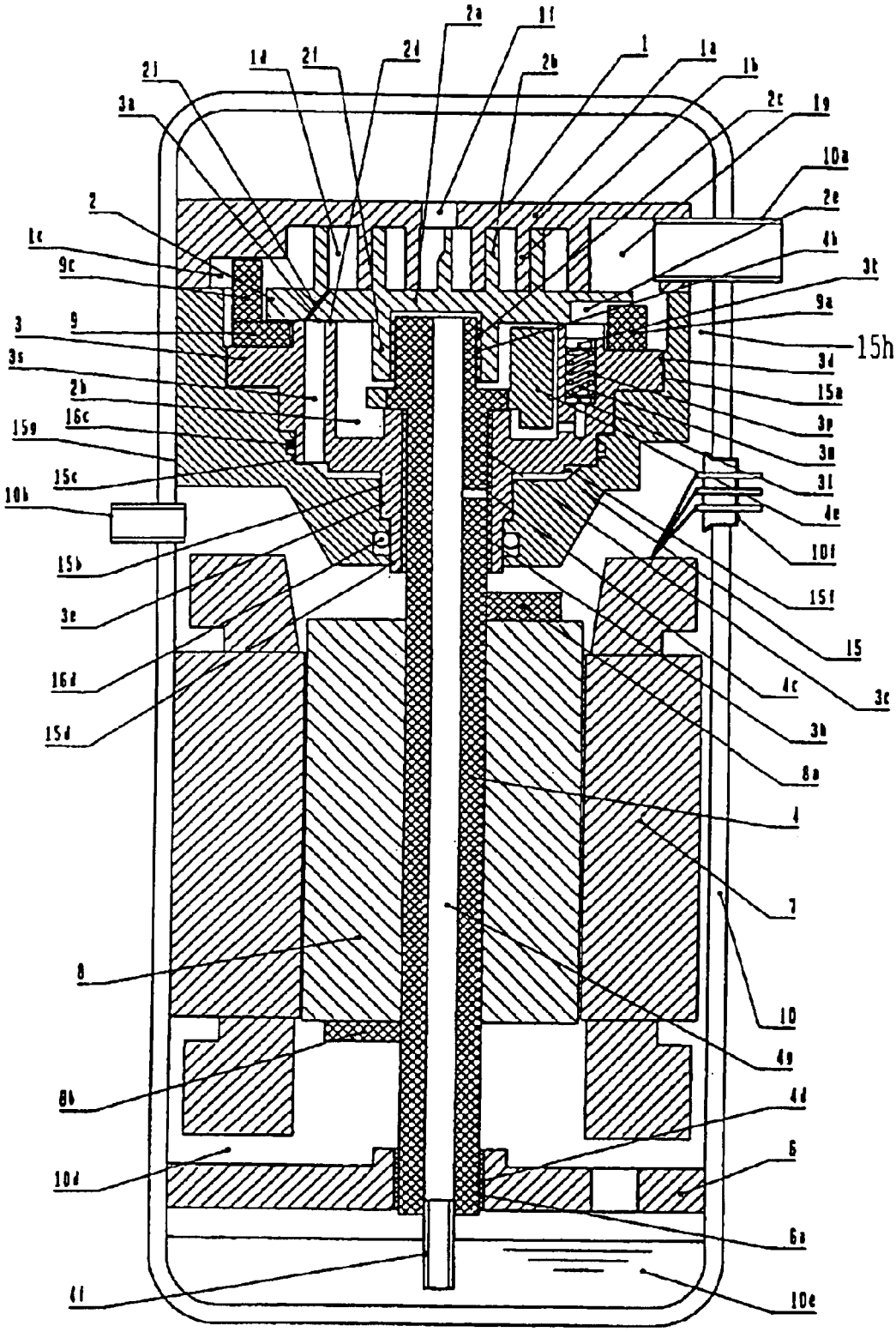
FIG. 1 is a longitudinal sectional view of Embodiment 1 of the present invention.

FIG. 1 is a longitudinal sectional view showing a scroll compressor of Embodiment 1. In Embodiment 1, the names and functions of respective parts are similar to their counterparts in the above-mentioned conventional apparatus. Therefore, those parts are designated by the same reference numerals and the description thereof will be omitted.

Two sealing materials for forming a frame space 15*f* are O-rings 16*c* and 16*d*. The O-rings 16*c* and 16*d* are disposed on cylindrical surfaces 15*d* and 15*d* formed by the inner circumference of a guide frame 15 and the outer circumference of a compliant frame 3. The O-rings are made of HNBR. There is no danger of the O-rings being swollen and deteriorated even when an HFC refrigerant is used. A suitable material may be selected for the O-rings in accordance with the kind of the refrigerant filling the compressor, the atmosphere temperature, and so on.

During the starting of the compressor, pressure Pm2 in the frame space 15*f* for extracting and introducing refrigerant gas on the way of compression in a compression chamber 1*d* increases more rapidly than the pressure Pd (i.e., discharge pressure) in a closed vessel. However, pressure leakage from the frame space 15*f* into the closed vessel can be prevented by the O-rings forming the frame space 15*f*. Accordingly, the pressure Pm2 in the frame space increases so quickly that a force tending to move the compliant frame 3 toward the compression chamber 1*d* is imparted to the compliant frame 3. Thus, a normal compressing operation can be started quickly.

A boss portion outside space 2*h* is disposed midway in an oil feed passageway of a refrigerating machine oil 10*e* in the closed vessel. The refrigerating machine oil 10*e* passes through the differential pressure oil feed passageway as follows. The refrigerating machine oil 10*e* in the high pressure bottom portion of the closed vessel passes through a main shaft hollow portion 4*g* and reaches the boss portion outside space via a main bearing 3*c* and an oscillating bearing 2*c*. Then, the refrigerating machine oil 10*e* is introduced into a low pressure space 1*g* via an intermediate pressure regulating valve receiving space 3*p* provided in the compliant frame 3. It is preset so that by virtue of the throttling action of the main bearing 3*c* and the oscillating bearing 2*c* and adjustment of the spring constant of an intermediate pressure regulating spring 3*m* which is provided in the regulating valve receiving space, the pressure Pm1 of the boss portion outside space 2*h* becomes such that the value α shown in the expression (1) becomes about 0.3. As a result, thrust contact force Fth is reduced to reduce the thrust sliding loss in the whole running pressure range of the compressor. At the same time, a normal compressing operation can be ensured without separating the oscillating scroll 2 and the compliant frame 3 from each other. In addition, a positive value is ensured for oil feed differential pressure ΔP of the refrigerant machine oil. Thus, there is no danger of the oil feeding to the oscillating bearing 2*c* and the main bearing 3*c* being interrupted.

The frame space 15*f* is filled with intermediate pressure refrigerant gas supplied continuously or intermittently through an extraction hole 2*j* and a communication passageway 3*s*. The pressure Pm2 in the frame space is set in accordance with the position of the compressor chamber 1*d* with which the extraction hole 2*j* communicates, so that the value β shown in the expression (3) becomes about 1.6. As a result, in the entire running pressure range of the compressor, tooth tip contact force Ftip does not assume a negative value. Thus, the oscillating scroll 2 and the fixed scroll 1 are prevented from separating from each other so that a normal compressing operation can be ensured. In addition, there is no danger of the sliding loss being increased by excessive pressing of the tooth tips.

Incidentally, the intermediate pressure acting area or the high pressure acting area of the boss portion outside space or the frame space is defined on the basis of the value α or the value β described above. The optimum values α and β change in accordance with the adjustment of these areas. Generally, an intermediate pressure acting area Spm1 of the boss portion outside space 2*h* is determined by geometric shapes of an Oldham's ring, a thrust bearing, and so on. Accordingly, the intermediate pressure acting area Spm1 has a limited degree of freedom in setting. On the other hand, an intermediate pressure acting area Spm2 of the frame space 15*f* has a relatively large degree of freedom in adjustment. It is therefore preferable that the intermediate pressure active area Spm2 is set to be as large as possible so that the value β is set to be small. That is, it is preferable that the intermediate pressure Pm2 of the frame space is set to be low. Thus, stable tooth tip contact force Ftip can be obtained in the wide running pressure range of the compressor. In addition, the compliant frame 3 and the oscillating scroll 2 can be moved toward the compression chamber by low intermediate pressure Pm2. Thus, calculative and experimental results have been obtained showing improvements in the starting characteristics of the compressor, or the like.

Now, description will be made about the setting of the value α determining the pressure Pm1 of the boss portion outside space 2*h*.

By setting the value α to be large, the thrust contact force Fth or the thrust sliding loss can be reduced as described previously in connection with the conventional apparatus. However, if the value α is set to be too large, that is, if the pressure Pm1 of the boss portion outside space 2*h* is set to be too high, the thrust contact force Fth assumes a negative value. Thus, there is a problem that the oscillating scroll 2 and the compliant frame 3 are separated from each other, or the differential pressure ΔP for feeding oil to the oscillating bearing 2*c* and the main bearing 3*c* cannot be ensured.

Figure 2:
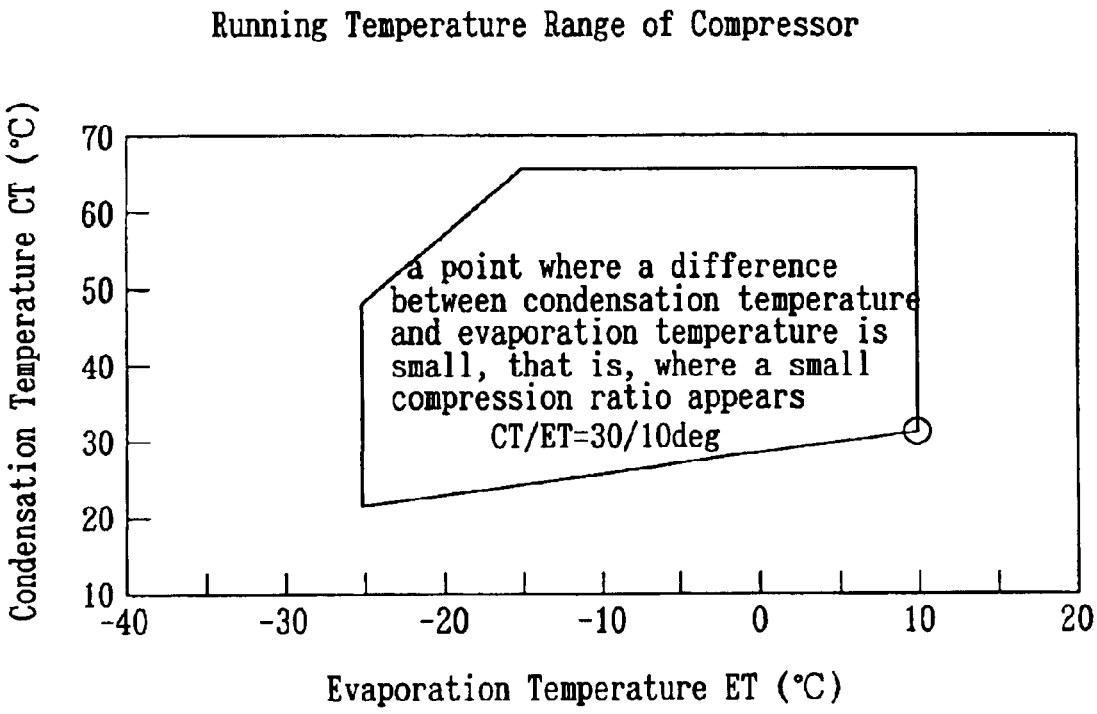
FIG. 2 is a graph showing the running temperature range of a compressor.

FIG. 2 shows an ordinary running temperature range quarantined by the compressor. Oil feeding has to be ensured in such a wide range. In FIG. 2, the condition that makes it difficult for the compressor to feed oil appears to be at a running point (low compression ratio) at which the difference between condensation temperature CT and evaporation temperature ET is minimum, that is, the difference between discharge pressure Pd and suction pressure Ps is minimum. In FIG. 2, this running point is a right lower point in the running temperature range, and the ratio CT/ET is 30/10° C. The difference min(Pd−Ps) between the discharge pressure Pd and the suction pressure Ps at this point varies in accordance with the refrigerant to be used. The points are summarized in FIG. 10.

A differential pressure head for feeding oil to the oscillating bearing 2 and the main bearing 3*c* becomes the differential pressure ΔP between the closed vessel pressure (i.e., discharge pressure) Pd and the boss portion outside space pressure Pm1 as shown in the expression (2). For example, in the case where the refrigerant used is R407C, if the value α reaches 0.6 or larger, the pressure Pm1 and the differential pressure ΔP take the following values respectively at the running point (Pd/Ps=1.27/0.71 MPa) shown in FIG. 10.

$$Pm1=Ps+\alpha=0.71+0.6=1.31(MPa)$$

$$\Delta P=Pd-Pm1=1.27-1.31=-0.04(MPa)<0$$

The value of the differential pressure ΔP shows that oil cannot be fed under such running pressure conditions. Specifically, in the case where R407C is used as a working refrigerant, the value α has to be set not larger than the value of the high/low pressure difference min(Pd−Ps), that is, not larger than 0.56 at the low compression ratio running pressure (Pd/Ps=1.27/0.71 MPa).

Likewise, the value α has to be set smaller than 0.51 (α<0.51) when R22 is used as a working refrigerant, and the value á has to be set smaller than 0.8 (α<0.8) when R410A is used as a working refrigerant. Otherwise, an area where no oil is fed appears in the running pressure range of the compressor. Therefore, the value α has to be set not larger than any one of the above-mentioned values.

Also in the case where the refrigerant to be used in the compressor or the running pressure range of the compressor differs from the above-mentioned refrigerant or running pressure range, it is necessary to set the value α to be not larger than the differential pressure value min(Pd−Ps) where a difference between high and low pressures is minimum in the running pressure range of the compressor.

Figure 3:
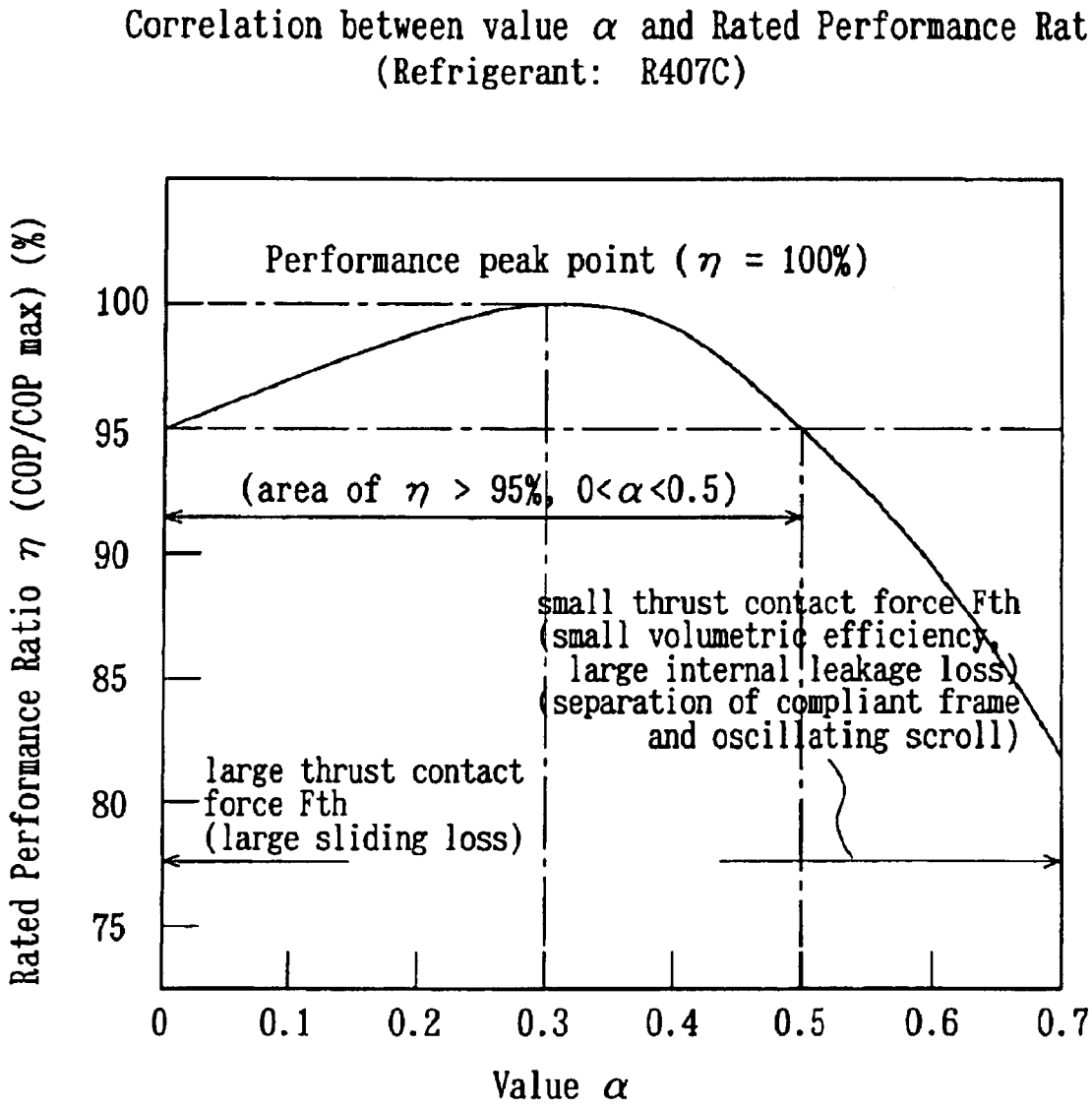
FIG. 3 is a graph showing the correlation between value a and rated performance ratio in the case where a refrigerant is R407C.

FIG. 3 shows the rated performance ratio when the value α is varied with R407C as a working refrigerant. The rated performance ratio is expressed by the performance ratio on the assumption that the performance MAX value is 100%. In the area where the value α is small, the effect of relieving the thrust contact force Fth cannot be obtained sufficiently, and there is a tendency that the thrust sliding loss increases so that the performance deteriorates gradually. If the value a is increased gradually, the effect of relieving the thrust sliding loss is exhibited so that the performance is improved. The performance reaches a peak (100%) when the value α is about 0.3. If the value α is increased further, the thrust sliding loss becomes smaller. However, the thrust contact force Fth becomes somewhat insufficient. Thus, upsetting moment generated in the oscillating scroll cannot be maintained so that, though a very small, a clearance begins to appear between the tooth tips. Thus, there is a tendency that the performance lowers again due to the deterioration of the volumetric efficiency or the increase of the internal leakage loss. If the value a exceeds 0.7, the thrust contact force Fth becomes completely insufficient. Thus, the compliant frame 3 and the oscillating scroll 2 are separated from each other so that the performance deteriorates rapidly. In FIG. 3, the value α which was required for ensuring the performance to be 95% or more with respect to the performance MAX value was in a range of from 0 to 0.5.

Next, description will be made about merits of this embodiment in the case where a high pressure working refrigerant is used.

A high pressure working refrigerant (e.g., R401A or R32) is higher in working/running pressure than any other refrigerant (e.g., R22 or R407C). Therefore, the radial load on the oscillating bearing 2*c* or the main bearing 3*c* and the load on the thrust bearing 3*a* increase.

Generally, in the case of high pressure working refrigerant, a stroke volume Vst of the compressor becomes small due to the thermal physical properties of the refrigerant itself. In order to relieve the stress generated in the scroll teeth due to the high pressure refrigerant, generally, the stroke volume Vst in the scroll compressor is adjusted by reducing the height of the scroll teeth or increasing the tooth thickness. In such a method, the radial load on the oscillating bearing 2*c* or the main bearing 3*c* can be reduced to the conventional level. However, in this method, the load on the thrust bearing cannot be reduced. Thus, the thrust sliding loss increases and therefore a decline in the performance of the compressor is caused.

In order to solve this problem, the scroll compressor according to the present invention is constructed so that the thrust bearing load can be reduced when the pressure Pm1 of the boss portion outside space 2*h* is set to be high (the value α is set to be large). In addition, as shown in FIG. 10, the value α, in the case of R410A, has an upper limit of about 0.8 to ensure the oil feed differential pressure. This upper limit is higher than that of any other refrigerant (R22 or R407C). Thus, the degree of freedom with which the value α can be set to be large is high so that the effect of reducing the thrust bearing load is also large. In other words, the scroll compressor shown in this embodiment exhibits advantages more as the pressure of working refrigerant is high.

Figure 4:
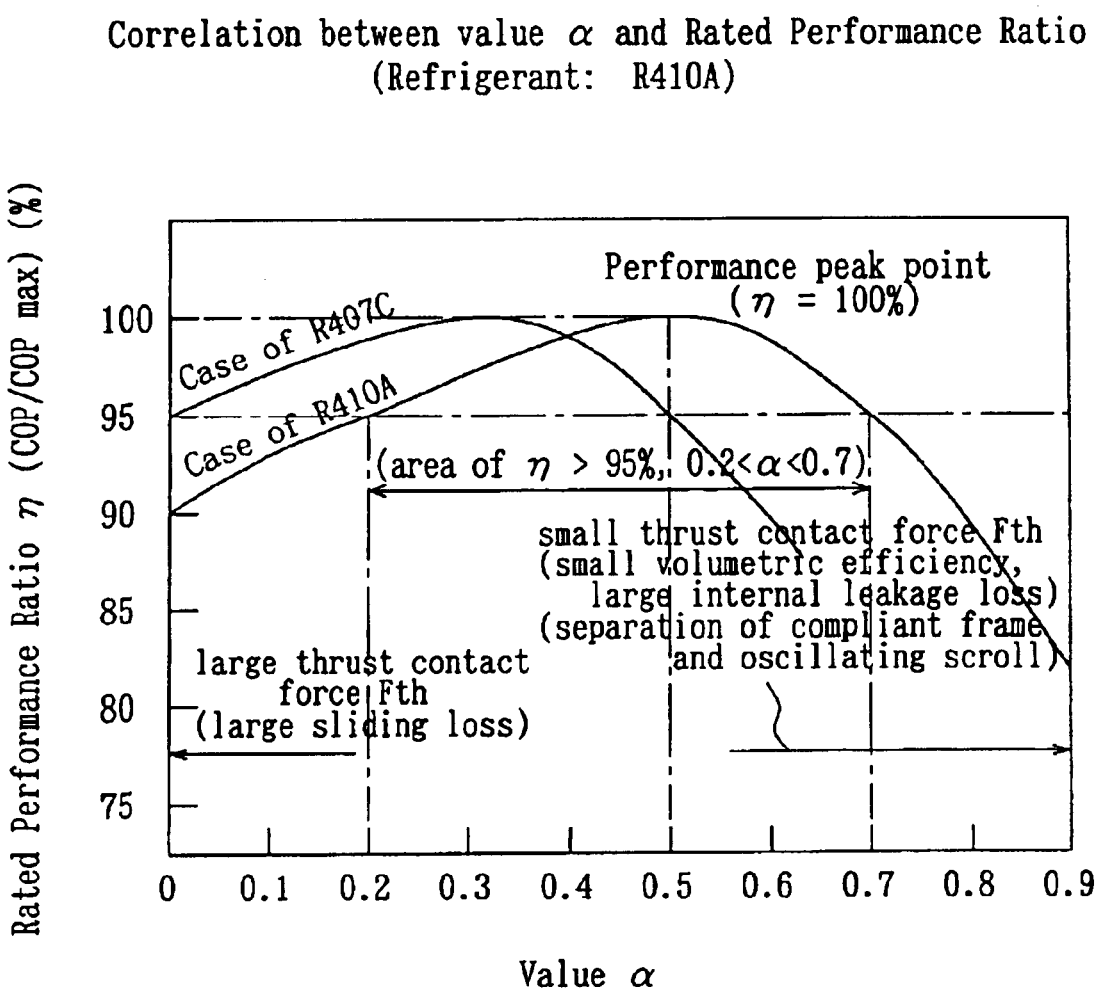
FIG. 4 is a graph showing the correlation between the value a and the rated performance ratio in the case where a refrigerant is R410A.

FIG. 4 shows the correlation between the value a and the rated performance ratio when R410A i.e., a high pressure working refrigerant is used. In FIG. 4, the correlation in the above-mentioned case of R407C is also shown.

In the area where the value α is small, the thrust bearing load is large. In addition, the effect of canceling the load according to this embodiment is not exhibited sufficiently. Thus, the performance ratio in the case of R410A takes a smaller value than that in the case of R407C. If the value α is increased gradually, the effect of canceling the thrust bearing load according to this embodiment appears. Then, the performance reaches a peak point at a higher level of the value a than that in the case of R407C. In this embodiment, the performance reached a peak point at α=0.5. As described above, the high pressure working refrigerant (R410A) has a larger thrust bearing load than R407C or R22. Accordingly, better performance can be obtained by setting the intermediate pressure Pm1 of the boss portion outside space 2*h* to be higher, that is, by setting the value α to be larger. If the value α is increased further, the thrust contact force Fth becomes so insufficient that the performance lowers again by the same reason as described in connection with FIG. 3.

In FIG. 4, the value a which was required for keeping the performance ratio to be 95% or more was approximately in a range of 0.2<α<0.7.

Accordingly, as shown in FIG. 10, it is necessary that the upper limit of the value α is set to be the differential pressure value min(Pd−Ps) at which the difference between high and lower pressures is minimum in the running pressure range of the compressor. The optimum value α is therefore not larger than the value min(Pd−Ps). The optimum value α must be determined experimentally by measuring the performance or the like within a range where the thrust contact force Fth is neither too small nor too large.

Although the value α changed somewhat in accordance with the intermediate pressure acting area Spm1, the optimum value α obtained experimentally in this embodiment was a value substantially in the vicinity of half the value min(Pd−Ps) shown in FIG. 10, i.e., α≈{min(Pd−Ps)}/2.

Next, description will be made about determination of the value β in the expression (3) for setting to a proper value the force Fpm2 in the expression (11), which tends to cause the guide frame 15 and the compliant frame 3 to be separated from each other.

If the value β is set to be too small, it becomes difficult to ensure a positive value for the tooth tip contact force Ftip at certain running pressures. Thus, a normal compressing operation cannot be warranted. On the other hand, if the value β is set to be too large, the tooth tip contact force Ftip in the expression (10) becomes larger than required. Thus, the resulting increase in sliding loss causes an inconvenience such as deterioration of the performance of the compressor, seizing of the tooth tips, or the like.

Figure 5:
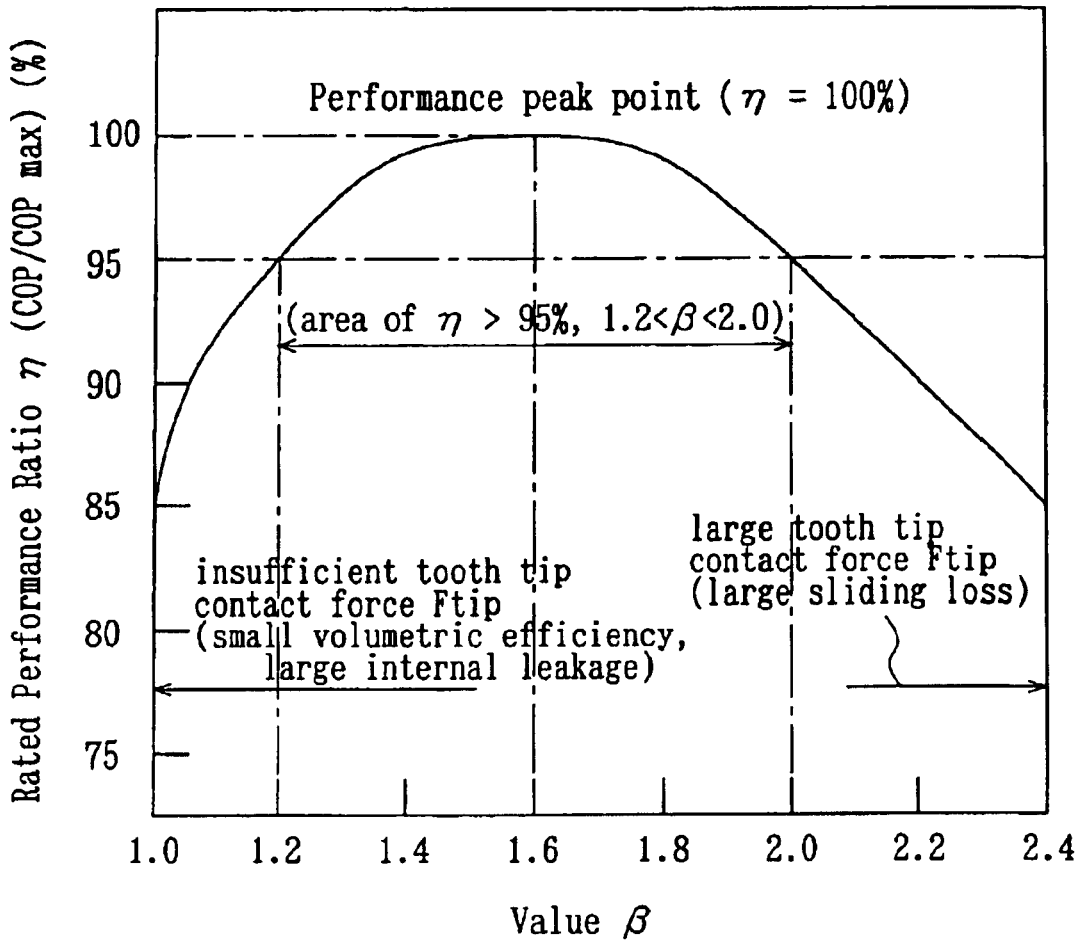
FIG. 5 is a graph showing the correlation between value 3 and the rated performance ratio.

FIG. 5 shows the rated performance ratio when the value β is varied in the scroll compressor of this embodiment. The rated performance ratio is expressed in terms of the performance ratio by taking the performance MAX value as 100% in the same manner as described above.

In the area where the value β is small, the tooth tip contact force Ftip is entirely insufficient. Thus, the compliant frame 3 and the oscillating scroll 2 cannot move toward the compression chamber so that a normal compressing operation cannot be carried out. Accordingly, the performance is considerably low. If the value β is increased gradually, the tooth tip contact force Ftip assumes a positive value, but the upsetting moment generated in the oscillating scroll 2 cannot be maintained so that a very small clearance appears at the tooth tips. Thus, the performance cannot be said sufficient as yet in view of the deterioration of the volumetric efficiency or the increase of the internal leakage loss. However, such a leakage phenomenon is reduced gradually in the vicinity of β=1.2 so that the tooth tip contact force Ftip becomes sufficient. Thus, the performance improves and reaches a peak (100%) at about β=1.6. Thereafter the tooth tip sliding loss increases due to the increase of the tooth tip contact force Ftip and the performance tends to deteriorate again.

In FIG. 5, the value β which was required for ensuring the performance ratio to be 95% or more was in a range of $1.2<\beta<2.0$.

Embodiment 2

Figure 6:
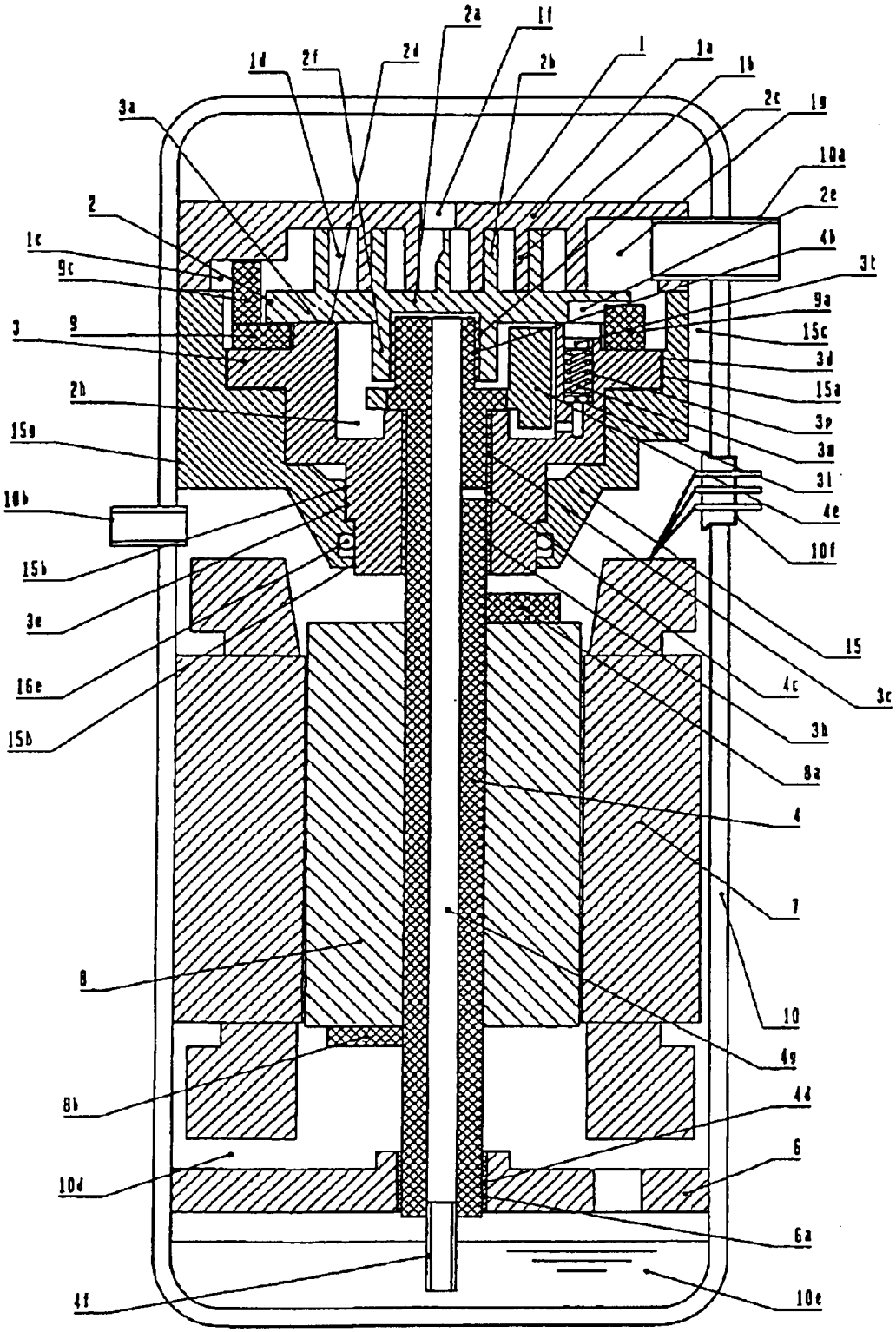
FIG. 6 is a longitudinal sectional view of Embodiment 2 of the present invention.
Figure 7:
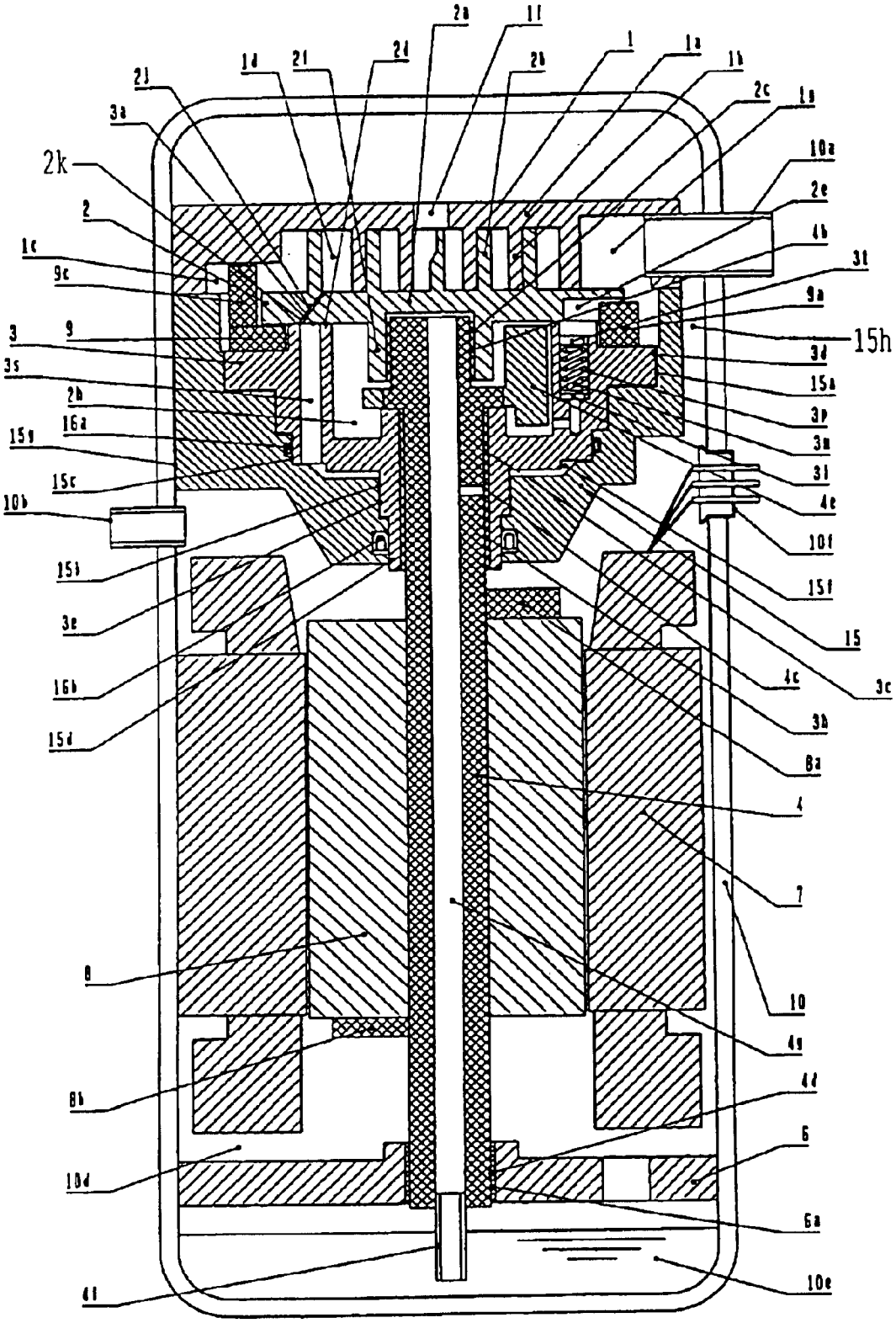
FIG. 7 PRIOR ART
FIG. 7 is a longitudinal sectional view of a conventional scroll compressor.
Figure 8:
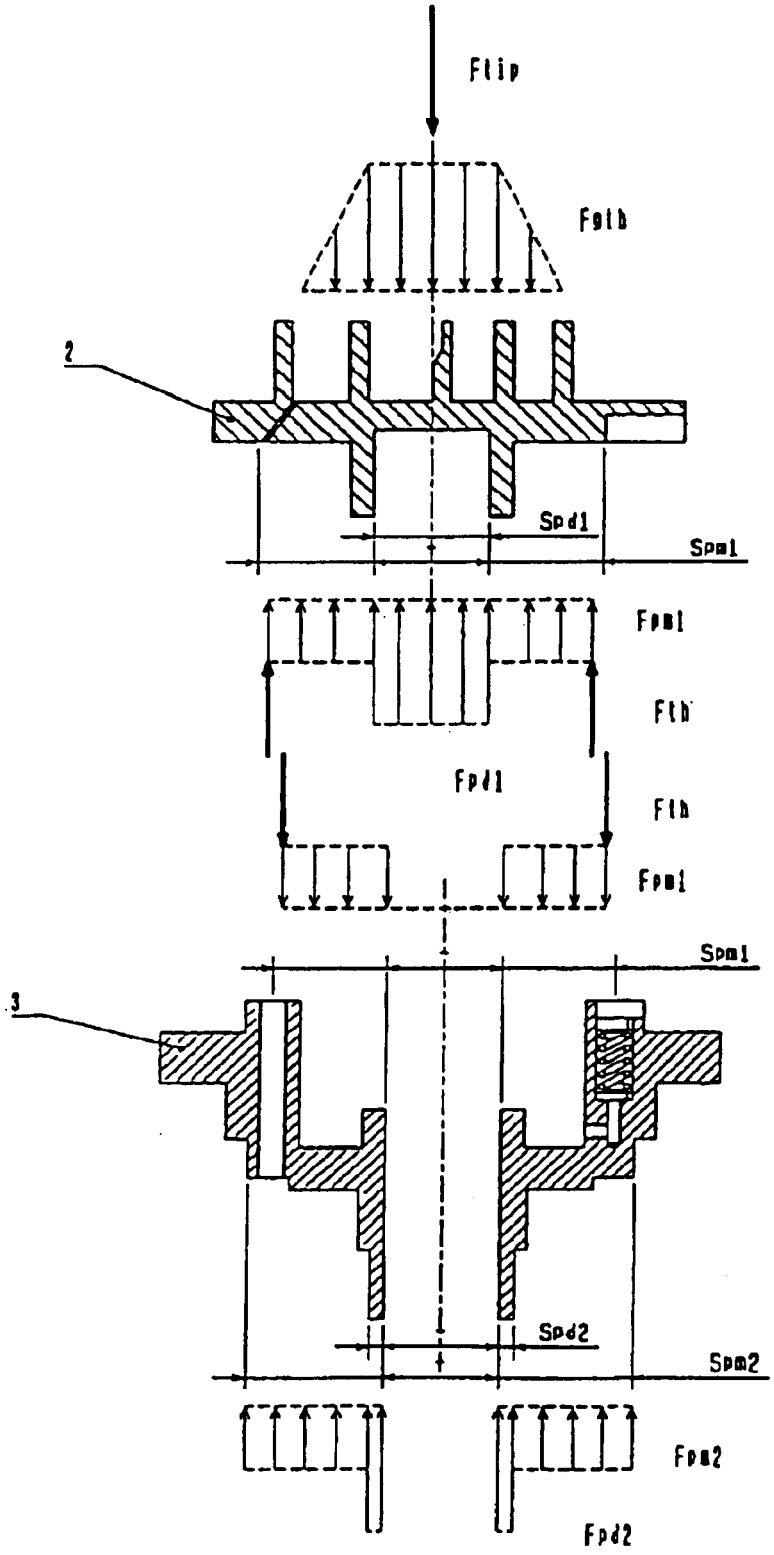
FIG. 8 PRIOR ART
FIG. 8 is an explanatory view of axial forces acting on the respective parts.
Figure 9:
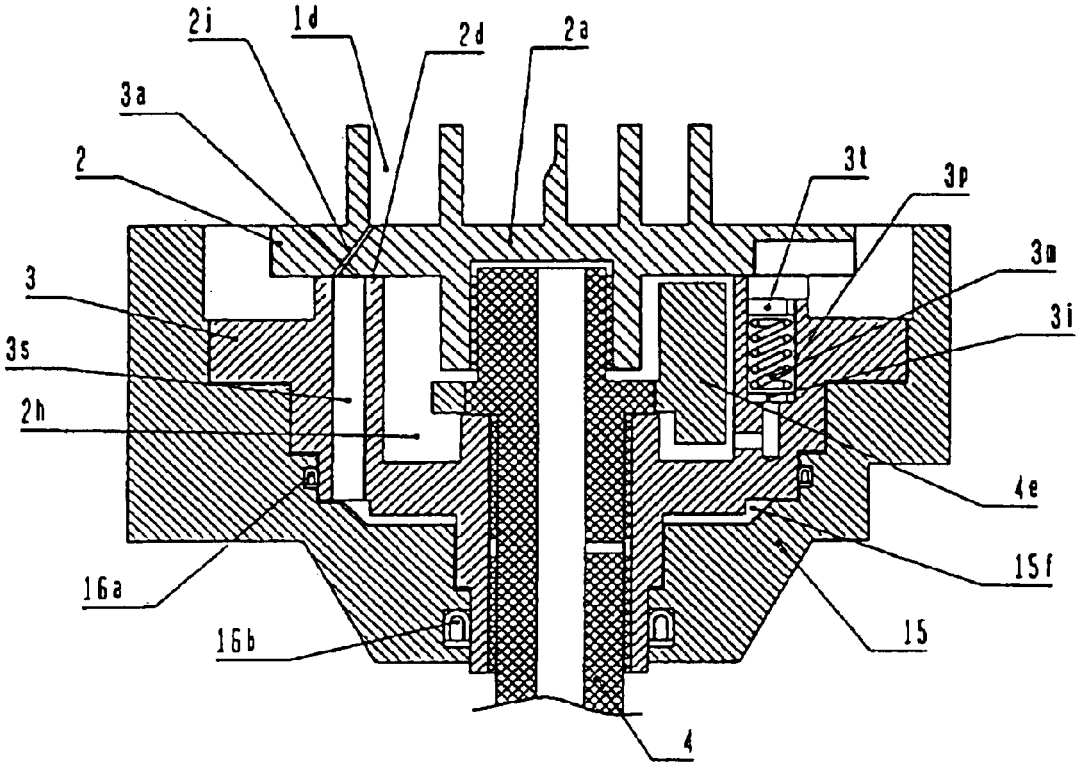
FIG. 9 PRIOR ART
FIG. 9 is an enlarged sectional view showing the sealing materials and the adjoining parts.

FIG. 6 is a longitudinal sectional view showing Embodiment 2. In Embodiment 2, the names and functions of the respective parts similar to their counterparts in Embodiment 1 are designated by the same reference numerals, and the description about them will not be made.

An O-ring 16*e* made of HNBR is disposed on a cylindrical engaging surface 15*h* formed by a compliant frame 3 and a guide frame 15. The compression chamber side of the O-ring 16*e* is open to a suction pressure atmosphere space 1*g* while the motor side of the O-ring 16*e* is open to a discharge pressure atmosphere. Further, in contrast to the embodiment shown in FIG. 1, the frame space 15*f*, the extraction hole 2*j*, the communication passageway 3*s*, and further either of the two pairs of O-rings and O-ring grooves are omitted.

In the embodiment shown in FIG. 1, the force Fpm2 which depends on the pressure Pm2 of the frame space 15*f* and which tends to separate the guide frame 15 and the compliant frame 3 from each other, acts as a force for moving the compliant frame 3 and the oscillating scroll 2 toward the compression chamber. Thus, in FIG. 1, the force Fpm2 takes part in causing the tooth tip contact force Ftip to assume a positive value. On the other hand, in FIG. 6, the frame space 15*f* itself does not exist. Therefore, the force Fpm2 tending to cause the guide frame 15 and the compliant frame 3 to be separated from each other is not produced. The area (Spd2') of the compliant frame lower end exposed to a high pressure atmosphere is set to be larger in order to make up the insufficiency of the tooth tip contact force Ftip. Thus, force (Fpd2') based on the differential pressure acting on the exposed portion is increased so that a function similar to that in Embodiment 1 is obtained. In other words, in Embodiment 1, the tooth tip contact force Ftip and the thrust contact force Fth are expressed by:

$$Ftip=Fpd1+Fpd2+Fpm2-Fgth \quad (10)$$

$$Fth=Fpm2+Fpd2-Fpm1 \quad (11)$$

while, in embodiment 2, they are expressed by:

$$Ftip=Fpd1+Fpd2'-Fgth \quad (16)$$

$$Fth=Fpd2'-Fpm1 \quad (17)$$

In order to ensure the tooth tip contact force Ftip and the thrust contact force Fth in Embodiment 2 similarly to those in Embodiment 1, from the simultaneous equations (11) and (17), the required force Fpd2' is expressed by:

$$Fpd2'=Fpd2+Pm2 \quad (18)$$

From (force=pressure×area), the exposed area Spd2' is expressed by:

$$(Pd\times Spd2')=(Pd\times Spd2)+(Pm2\times Spm2) \quad (19)$$

$$Spd2'=Spd2+(Pm2/Pd)\times Spm2 \quad (20)$$

That is, in Embodiment 2, the effect similar to that in Embodiment 1 can be obtained if the area (Spd2') exposed to the high pressure atmosphere is set in accordance with the expression (20) by use of the values shown in Embodiment 1. In other words, there is realized the scroll compressor which is reduced in the number of component parts, low in cost and superior in productivity.

What is claimed is:

1. A scroll compressor provided in a closed vessel, comprising:

a fixed scroll and an oscillating scroll respectively having plate-like scroll teeth in gear with each other so as to form a compression chamber therebetween;

a compliant frame for supporting said oscillating scroll in an axial direction of said scroll compressor while supporting a main shaft in a radial direction of said scroll compressor for driving said oscillating scroll, said compliant frame being displaceable in said axial direction; and a guide frame for supporting said compliant frame in said radial direction, said oscillating scroll being made movable in said axial direction due to movement of said compliant frame in said axial direction relative to said guide frame;

wherein said oscillating scroll has a thrust surface on a surface opposite to said plate-like scroll teeth;

wherein a boss portion outside space formed inside a thrust bearing of said compliant frame slidable in pressure contact with said thrust surface is disposed midway in a differential pressure oil feed passageway for feeding lubricating oil by use of a running high/low pressure difference of said compressor; and wherein on the assumption that pressure Pm1 (MPa) of said boss portion outside space determined by a restrictor and a pressure regulator provided midway in said oil feed passageway is expressed by Pm1 =Psα and a differential pressure value at which a difference between high and low pressures becomes minimum in a running pressure range of said scroll compressor is represented by min(Pd−Ps), said value α in said expression is set to fall in a range of:

$$0<\alpha<\min(pd-Ps)$$

where Ps is suction pressure (MPa) of said compressor

Pd is discharge pressure (MPa) of said compressor.

2. A scroll compressor according to claim 1, wherein refrigerant gas on a way of compression is extracted from said compression chamber and introduced into a closed frame space formed by disposing two sealing materials respectively on two cylindrical surfaces or flat surfaces formed by said compliant frame and said guide frame; and wherein pressure Pm2 (MPa) in said frame space is set to fall in a range of not less than 1.2 times and not more than 2 times said suction pressure Ps (MPa) of said compressor.

3. A scroll compressor according to claim 2, wherein said sealing material or materials are O-rings.

4. A scroll compressor according to claim 2, wherein an O-ring or O-rings made of HNBR in which hydrogen atoms are bonded with a part of acrylonitrile-butadiene rubber molecules are used for said sealing material or materials when an HFC refrigerant is used as a working fluid.

5. A scroll compressor according to claim 1, wherein a sealing material for stopping fluid from moving from a high pressure space to a low pressure space is disposed on a cylindrical surface or a flat surface formed by said compliant frame and said guide frame.

6. A scroll compressor according to claim 5, wherein said sealing material or materials are O-rings.

7. A scroll compressor according to claim 5, wherein an O-ring or O-rings made of HNBR in which hydrogen atoms are bonded with a part of acrylonitrile-butadiene rubber molecules are used for said sealing material or materials when an HEC refrigerant is used as a working fluid.

8. A scroll compressor provided in a closed vessel, comprising:

a fixed scroll and an oscillating scroll respectively having plate-like scroll teeth in gear with each other so as to form a compression chamber therebetween;

a compliant frame for supporting said oscillating scroll in an axial direction of said scroll compressor while supporting a main shaft in a radial direction of said scroll compressor for driving said oscillating scroll, said compliant frame being displaceable in said axial direction; and a guide frame for supporting said compliant frame in said radial direction, said oscillating scroll being made movable in said axial direction due to movement of said compliant frame in said axial direction relative to said guide frame;

wherein refrigerant gas on a way of compression is extracted from said compression chamber and introduced into a closed frame space formed by disposing two sealing materials respectively on two cylindrical surfaces or flat surfaces formed by said compliant frame and said guide frame; and wherein pressure Pm2 (MPa) in said frame space is set to fall in a range of not less than 1.2 times and not more than 2 times said suction pressure Ps (MPa) of said compressor.

9. A scroll compressor according to claim 8, wherein said sealing material or materials are O-rings.

10. A scroll compressor according to claim 8, wherein an O-ring or O-rings made of HNIBR in which hydrogen atoms are bonded with a part of acrylonitrile-butadiene rubber molecules are used for said sealing material or materials when an HFC refrigerant is used as a working fluid.

* * * * *

UNITED STATES PATENT AND TRADEMARK OFFICE

CERTIFICATE OF CORRECTION

PATENT NO. : 6,769,887 B2 
DATED : August 3, 2004
INVENTOR(S) : Kiyoharu Ikeda et al.

It is certified that error appears in the above-identified patent and that said Letters Patent is hereby corrected as shown below:

Column 16,
Line 54, change "Pm1=Psα" to -- Pm1=Ps+α --.

Signed and Sealed this

Eighth Day of February, 2005

JON W. DUDAS
*Director of the United States Patent and Trademark Office*